US010576004B1

(12) United States Patent
Frances

(10) Patent No.: US 10,576,004 B1
(45) Date of Patent: Mar. 3, 2020

(54) PATIENT MOVEMENT DEVICE

(71) Applicant: Joane Frances, Spring Valley, CA (US)

(72) Inventor: Joane Frances, Spring Valley, CA (US)

( * ) Notice: Subject to any disclaimer, the term of this patent is extended or adjusted under 35 U.S.C. 154(b) by 0 days.

(21) Appl. No.: 16/275,876

(22) Filed: Feb. 14, 2019

Related U.S. Application Data

(60) Provisional application No. 62/793,531, filed on Jan. 17, 2019.

(51) Int. Cl.

| | |
|---|---|
| ***A61G 7/10*** | (2006.01) |
| ***A61G 7/14*** | (2006.01) |
| ***A47G 9/02*** | (2006.01) |
| ***A61G 7/057*** | (2006.01) |

(52) U.S. Cl.
CPC ..... *A61G 7/1026* (2013.01); *A47G 9/0238* (2013.01); *A61G 7/057* (2013.01); *A61G 2200/16* (2013.01)

(58) Field of Classification Search
CPC .. A61G 7/1025; A61G 7/1026; A61G 7/1023; A61G 7/1051
USPC ..... 5/81.1 HS, 81.1 T, 89.1, 925, 926
See application file for complete search history.

(56) References Cited

U.S. PATENT DOCUMENTS

| | | | | | |
|---|---|---|---|---|---|
| 3,829,914 | A * | 8/1974 | Treat | A47C 21/00 | 5/81.1 T |
| 4,277,859 | A * | 7/1981 | Seaman | A45C 9/00 | 383/25 |
| 4,991,245 | A * | 2/1991 | Franco | A45F 4/02 | 190/1 |
| 5,329,655 | A * | 7/1994 | Garner | A61G 7/1026 | 5/502 |
| 5,442,821 | A * | 8/1995 | Weeks | A61G 1/01 | 5/627 |
| 5,465,441 | A * | 11/1995 | Chun | A47C 7/021 | 5/653 |
| 5,638,558 | A * | 6/1997 | Moore | A61G 7/1026 | 5/502 |
| 6,728,978 | B1 * | 5/2004 | Nordin | A47C 27/005 | 5/484 |
| 2016/0242580 | A1 * | 8/2016 | Batiste | A47G 9/0253 | |

* cited by examiner

*Primary Examiner* — Robert G Santos
(74) *Attorney, Agent, or Firm* — Knobbe, Martens, Olson & Bear, LLP

(57) ABSTRACT

In order for a single caregiver to maneuver a bedridden patient without further assistance, the present disclosure describes a movement device and methods of its use. In some instances, the movement device may be able to be left under the bedridden patient without negatively affecting the patient, such as irritating the patient's skin.

17 Claims, 4 Drawing Sheets

PATIENT MOVEMENT DEVICE

INCORPORATION BY REFERENCE TO ANY PRIORITY APPLICATIONS

Any and all applications for which a foreign or domestic priority claim is identified in the Application Data Sheet as filed with the present application, including U.S. Provisional Patent Application No. 62/793,531 filed Jan. 17, 2019, are hereby incorporated by reference under 37 CFR 1.57.

BACKGROUND

Bedridden patients without the ability to maneuver themselves require assistance to accomplish the most menial tasks in bed, such a rolling to one side or adjusting to a more comfortable position in bed. Such assistance may be required for the entirety of a day, and larger or heavier patients typically require more than one person to assist them. Without receiving the necessary assistance, a bedridden patient may develop pressure ulcers (commonly known as bedsores), among other ailments.

A traditional transfer sheet may be used to assist a caregiver in maneuvering a patient. However, traditional transfer sheets and their traditional methods of use still require the assistance of more than one person, especially to maneuver a heavier bedridden patient.

SUMMARY

For purposes of summarizing the disclosure and the advantages achieved over the prior art, certain objects and advantages of the disclosure are described herein. Not all such objects or advantages may be achieved in any particular embodiment. Thus, for example, those skilled in the art will recognize that the invention may be embodied or carried out in a manner that achieves or optimizes one advantage or group of advantages as taught herein without necessarily achieving other objects or advantages as may be taught or suggested herein.

In a first aspect, a method of adjusting a bedridden patient by a single caregiver is provided. The method includes pulling a movement device, the movement device positioned between the bedridden patient and a bed surface. The movement device includes a first layer of low friction textile material in contact with the bed surface. The movement device further includes a second layer of a delicate textile material in contact with the bedridden patient. The method further includes wherein the position of the bedridden patient is adjusted.

In some embodiments of the method, the bed surface is flat. In some embodiments of the method, the bed surface is angled. In some embodiments, pulling is performed in a direction parallel to the bed surface. In some embodiments, pulling is performed using at least one handle positioned on the movement device.

In some embodiments, the bedridden patient suffers from multiple trauma, suffers from a fracture of the spine, suffers from paralysis, suffers from a severe disease, suffers from a head injury, is comatose, or is recovering from surgery. In some embodiments, the bedridden patient is obese. In some embodiments, the bedridden patient is about 200 lbs. or more, and the caregiver is about 150 lbs. or less. In some embodiments, the weight ratio between the bedridden patient and caregiver is about 1.5:1 or more.

In some embodiments, the method further comprises leaving the movement device between the bedridden patient and the bed surface for at least 12 hours without the patient developing pressure ulcers. In some embodiments, the position of the bedridden patient is adjusted either by moving the position of the bedridden patient by at least partially turning the patent from one side to another side, or by moving the patent from a first position to a second position. In some embodiments, the first position is on the same general plane as the second position. In some embodiments, in the first position the patient is at least partially laying down and in the second position the patient is in a substantially more sitting up position relative to the first position. In some embodiments, the position of the bedridden patient is adjusted to enable washing of the patient, changing the clothing of the patient, exercising the patient, rolling the patient, or making the patient more comfortable. In some embodiments, the bedridden patient's position is adjusted to alleviate areas of the patient's skin experiencing higher pressures. In some embodiments, the bedridden patient's position is adjusted from the bedridden patient's back to the bedridden patient's side. In some embodiments, the position of the bedridden patient is adjusted to prevent pressure ulcers. In some embodiments, the bed surface is not substantially disturbed after the position of the bedridden patient is adjusted.

In some embodiments, the method is repeated at least once. In some embodiments, the movement device further comprises a third layer of a strengthening material positioned between the first and second layers.

In a second aspect, a movement device to enable a single caregiver to move a patient is provided. The movement device includes a first layer comprising a low friction textile material. The movement device may further include a second layer comprising a durable textile material. The movement device further includes a third layer comprising a delicate textile material. The first layer is the bottom most layer of the movement device positioned to contact a bed, and the third layer is the top most layer of the movement device positioned to contact the patient.

In some embodiments of the movement device, the low friction textile material is a satin material or a silk material. In some embodiments, the low friction textile material has a dynamic frictional coefficient of at most about 0.7. In some embodiments, the durable textile material is a polyester material. In some embodiments, the second layer comprises at least about 50% polyester. In some embodiments, the delicate textile material is a cotton material. In some embodiments, the delicate textile material is breathable.

In some embodiments, the movement device further comprise at least one handle positioned on the first layer. In some embodiments, the movement device comprises four device edges. In some embodiments, the movement device comprises 3 handles positioned on each of the four device edges. In some embodiments, the movement device is machine washable. In some embodiments, the first layer further comprises a water resistant material or a water proof material.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION

In order for a single caregiver to maneuver a bedridden patient without further assistance, the present disclosure describes a movement device and its methods of its use.

As the movement device and its methods of use allow a single caregiver to assist a bedridden patient, the movement device may financially assist a bedridden patient in receiving the necessary care for his or her condition. Unexpectedly, such a movement device and its methods of use allow a single caregiver to maneuver a bedridden patient (without assistance) so that the bedridden patient does not develop pressure ulcers, the severity of pressure ulcers are managed, and/or pressure ulcers may begin to heal. Surprisingly, such a movement device and its methods of use allow a single caregiver to maneuver a bedridden patient even if there is a large disparity between the sizes or weights between the bedridden patient and the caregiver (e.g. the caregiver is smaller than the bedridden patient), or if the caregiver, without the movement device, is not strong enough to maneuver the bedridden patient.

In some instances, the movement device is able to be left under the bedridden patient without negatively affecting the patient, such as irritating the patient's skin. A movement device that can be left under a bedridden patient further eliminates the need for the assistance of an additional caregiver, and ensures that the patient is not moved into a less favored position.

Movement Device

Figure 1:
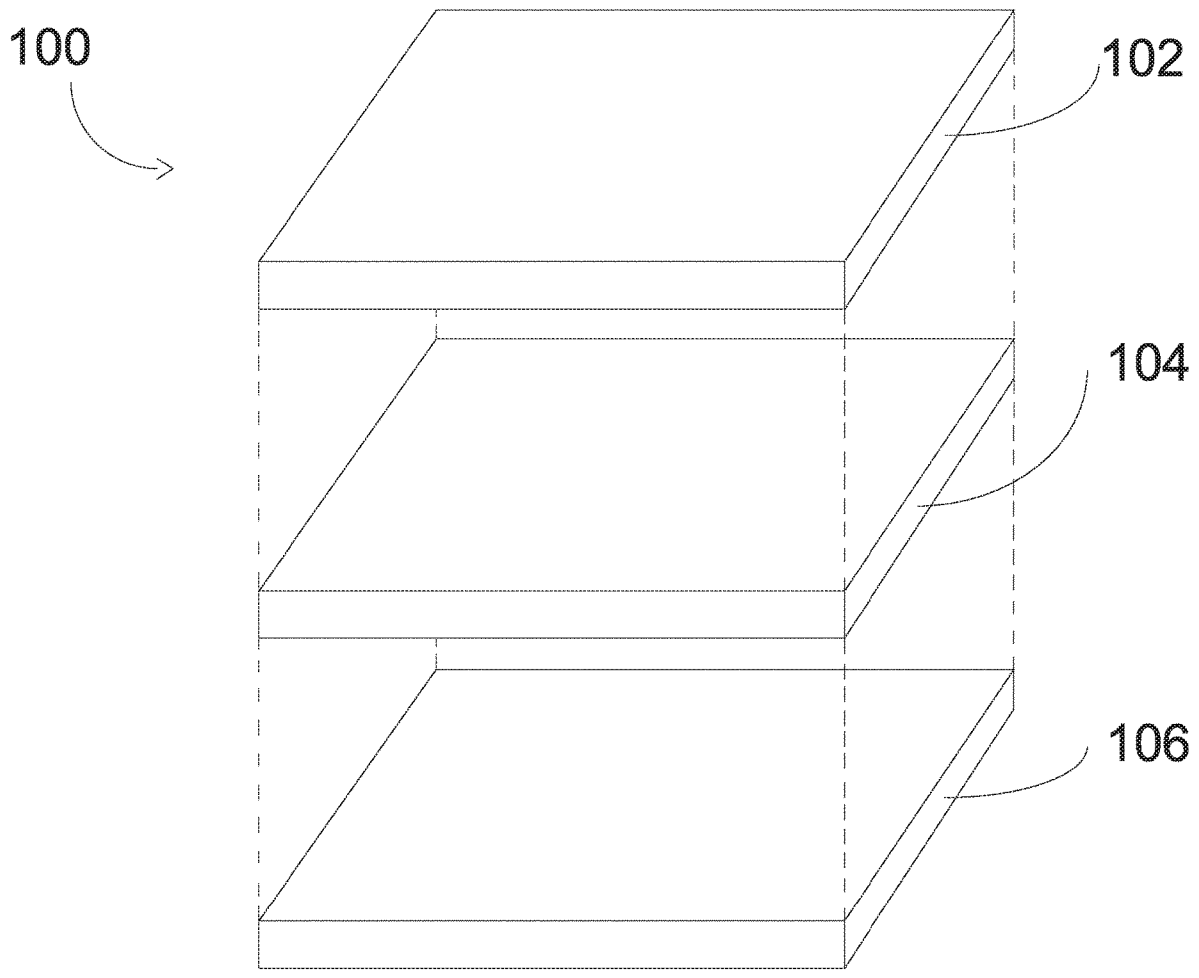
FIG. 1 illustrates a perspective exploded view of one embodiment of a movement device.

FIG. 1 illustrates a perspective exploded view of one embodiment of a movement device 100. The movement device 100 comprises a first layer 102, a second layer 104 and a third layer 106. Although movement device 100 is illustrated with a second layer 104, it should be understood that in some embodiment a movement device may be absent of a second layer. It should also be understood that labeling of the layers of the movement device as first, second or third are for the purpose of convention, and that such labels may be interchanged.

It is important to select the characteristics of the materials used in the first, second and third layers. In some embodiments, the first layer comprises a low friction textile cloth. A low friction textile cloth may be any textile cloth that allows the position of the bedridden patient on the movement device to be adjusted with ease, as the low friction cloth allows the device to easily slide on bed. In some embodiments, the first layer is the bottom most layer of the movement device. In some embodiments, the low friction textile cloth is a satin material. In some embodiments, the low friction textile cloth is a silk material. In some embodiments, the low friction textile cloth has a dynamic frictional coefficient of about or at most about 2, 1.5, 1, 0.9, 0.8, 0.7 0.6, 0.5, 0.4, 0.3, 0.2 or 0.1, or any range of values therebetween.

In some embodiments, the second layer comprises a durable textile cloth. A durable textile cloth may be any textile cloth that provides the movement device with additional strength so the bedridden patient can be adjusted without tearing or breaking the movement device. In some embodiments, the durable textile cloth is a polyester material. In some embodiments, the second layer comprises about or at least about 20%, 30%, 40%, 50%, 60%, 70%, 80%, 90% or 100% polyester, or any range of values therebetween.

In some embodiments, the third layer comprises a delicate textile cloth. A delicate textile cloth may be any textile cloth that may comfortably be in direct contact with a person's skin for extended periods of time. In some embodiments, the third layer is the top most layer of the movement device. In some embodiments, the delicate textile cloth is a bedding material. In some embodiments, the delicate textile cloth is a cotton material. In some embodiments, the delicate textile cloth is breathable. The term "breathable" is to be understood as allowing moisture vapor to be transmitted through a material, especially when in contact with a patient's skin.

In some embodiments, the movement device may be machine washable. In some embodiments, the first layer further comprises a water resistant material. In some embodiments, the first layer further comprises a water proof material.

In some embodiments, the edges and/or sides of the first, second and third layers of the movement device are stitched or sewn together. In some embodiments, the movement device further comprises additional stitching between the edges and/or sides of the movement device, for example such as a line of stitching through the middle of the movement device. Such additional stitching may impart additional strength or sturdiness into the movement device.

Figure 2:
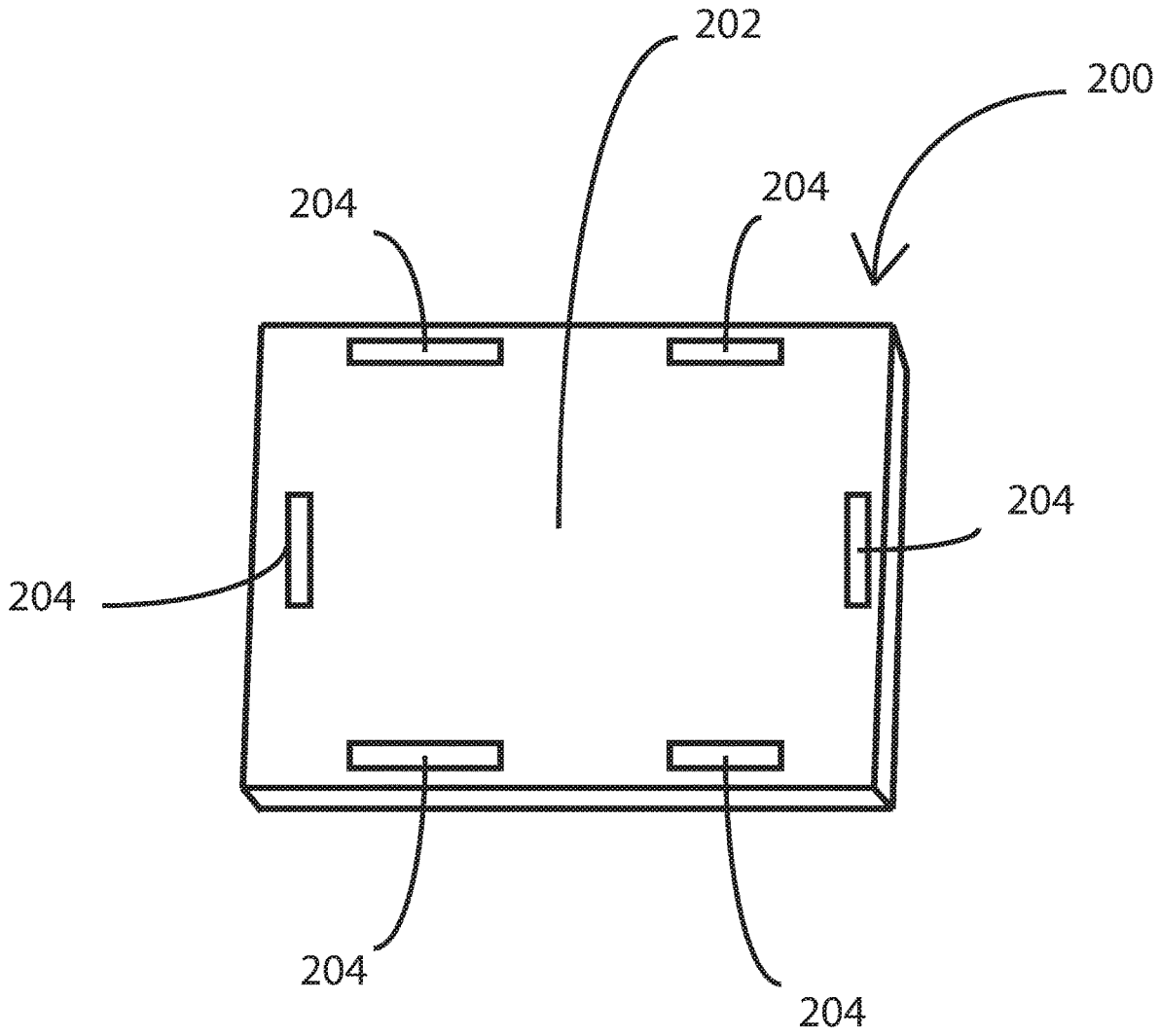
FIG. 2 illustrates top view of one embodiment of a movement device comprising handles.

FIG. 2 illustrates top view of one embodiment of a movement device 200 comprising handles. In some embodiments, the movement device 200 comprises a first layer, a second layer, a third layer, or any combinations thereof as previously described herein, for example such as movement device 100 shown in FIG. 1. The movement device 200 comprises a layer 202 and handles 204 positioned on the layer. In some embodiments, layer 202 comprises a low friction textile material. In some embodiments, layer 202 is the bottom most layer of the movement device. In some embodiments, layer 202 comprises a delicate textile material. In some embodiments, layer 202 is the top most layer of the movement device 200.

Although movement device 200 is depicted comprising six handles 204, it is to be understood that the movement device may comprise any number of handles positioned near any number of sides or edges of the movement device. In some embodiments, the movement device comprises or comprises at least 1, 2, 3, 4, 5, 6, 7, 8, 9, 10, 11, 12, 13 or 14 handles, or any range of values therebetween. In some embodiments, the handles 204 protrude from the edge of the movement device 200. In some embodiments, the handles 204 are substantially rectangular holes in edges of the movement device 200. In some embodiments, the handles are located near 1, 2, 3 or 4 edges of the movement device. In some embodiments, the handles can comprise a nylon webbing material.

Figure 3:
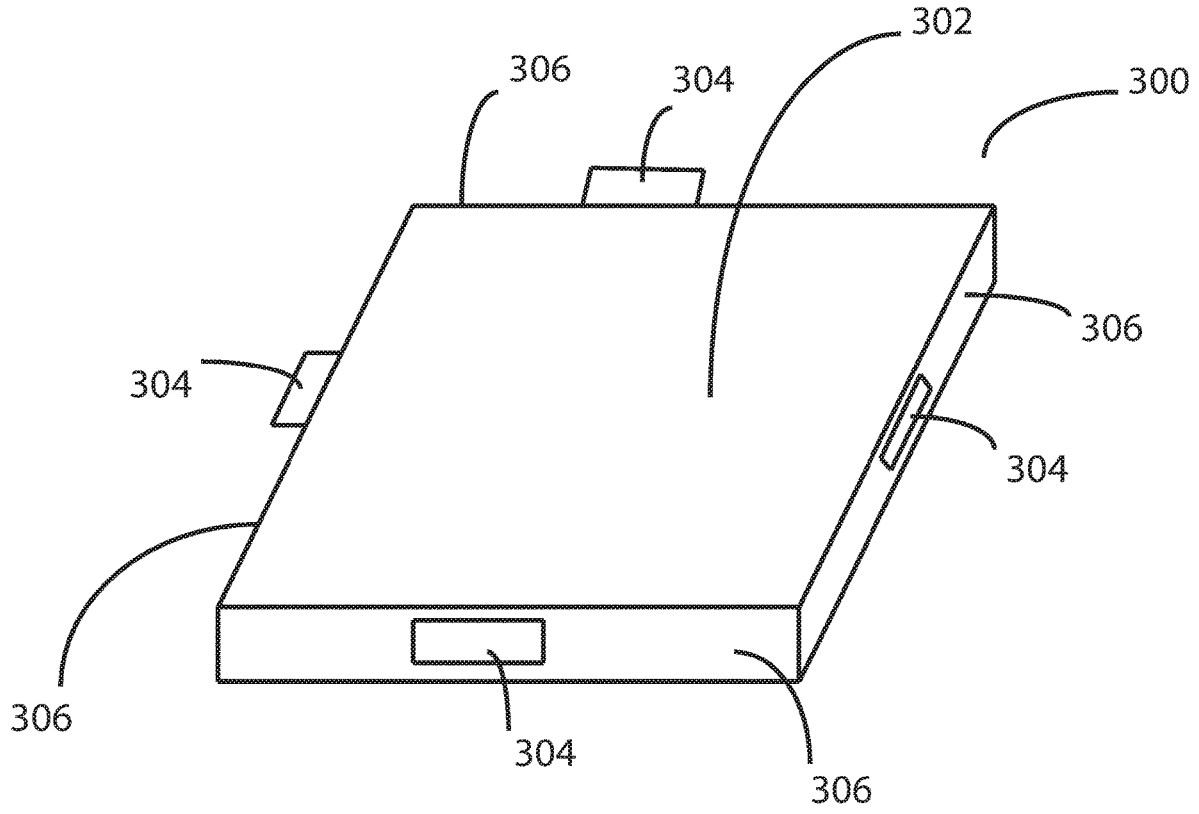
FIG. 3 illustrates a top view of one embodiment of a movement device comprising side handles.

FIG. 3 illustrates top view of one embodiment of a movement device 300 comprising side handles. In some embodiments, the movement device 300 comprises a first layer, a second layer, a third layer, or any combinations thereof as previously described herein, for example such as movement device 100 shown in FIG. 1. The movement device 300 comprises a layer 302, handles 304 and device edges 306, wherein the handles 304 are positioned on the device edges 306. Although movement device 300 is depicted comprising four handles 304, it is to be understood that the movement device may comprise any number of handles. In some embodiments, the movement device comprises or comprises at least 1, 2, 3, 4, 5, 6, 7, 8, 9, 10, 11, 12, 13 or 14 handles, or any range of values therebetween. In some embodiments, the movement device comprises or comprises at least 1, 2, 3, 4, 5, 6, 7, 8, 9, 10, 11, 12, 13 or 14 handles on each of the device edges, or any range of values therebetween. Although movement device 300 is depicted comprising four device edges 306, it is to be understood that the movement device may comprise any number of edges and may be made in any shape (e.g. triangular, square, rectangular, circular, etc. . . . ). In some embodiments, the movement device comprises or comprises at least 1, 2, 3, 4, 5, 6, 7, 8, 9, 10, 11, 12, 13 or 14 device edges, or any range of values therebetween. As with the movement device 200 illustrated in FIG. 2, in some embodiments, the handles 304 protrude from the edge of the movement device 300. In some embodiments, the handles 304 are substantially rectangular holes in edges of the movement device 300. For example, as seen in FIG. 3, two of the handles 304 protrude from the edge of the movement device and two of the handles 304 are substantially rectangular holes in the edges of the movement device.

Method of Use

The apparatuses or movement device described herein may be used in various methods.

Figure 4:
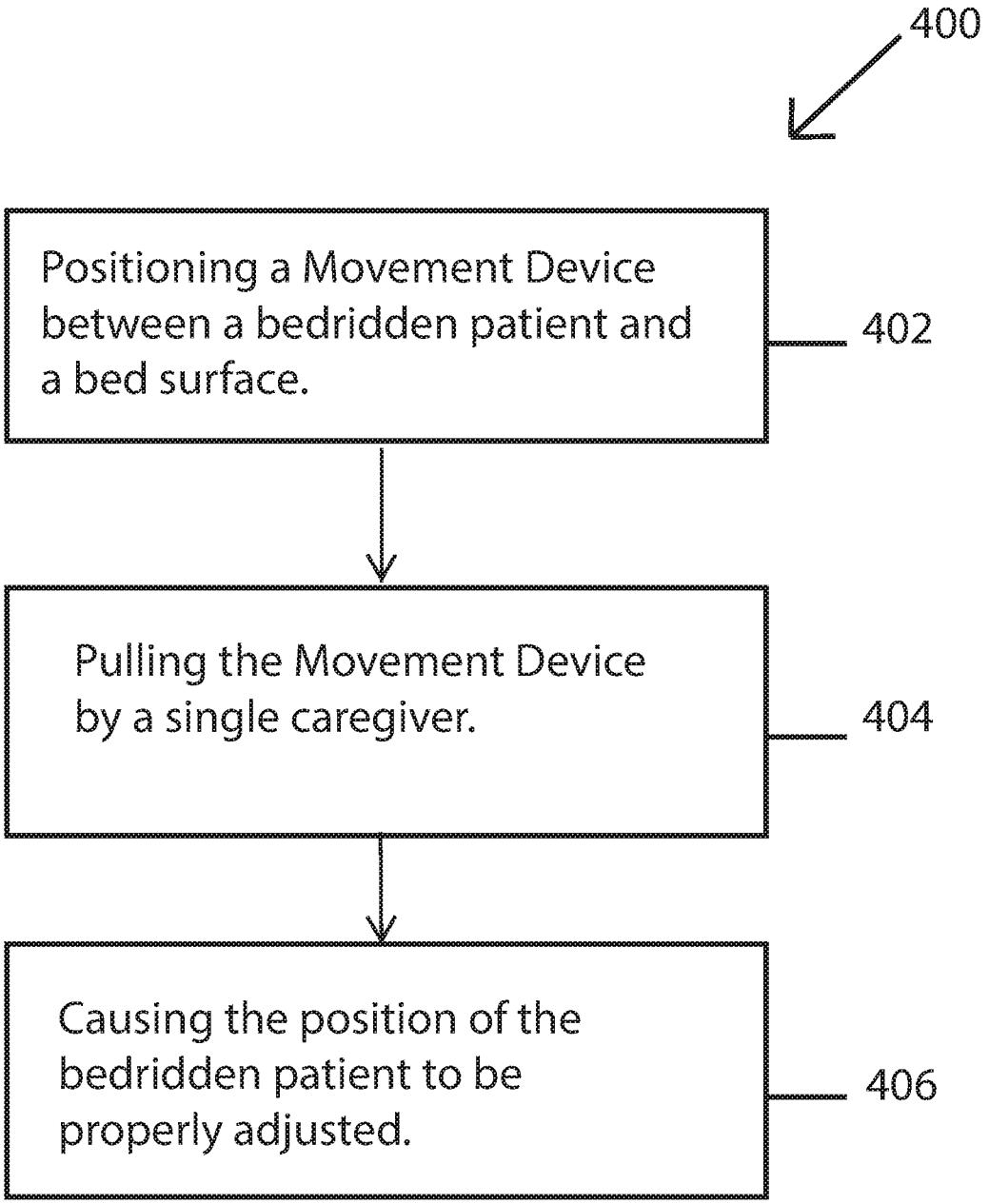
FIG. 4 depicts a flowchart of a method of using a movement device.

FIG. 4 is a flow diagram showing an example method 400 for using a movement device, according to some embodiments. In block 402, a movement device is positioned between a bedridden patient and a bed surface. In block 404, a single caregiver pulls the movement device, which in block 406 causes the position of the bedridden patient to be adjusted. In some embodiments, pulling of the movement device is performed in a direction parallel to the bed surface. In some embodiments, the method of using the movement device comprises step 402, 404, 406, or any combination thereof. In some embodiments, for example, a method may comprise a single caregiver pulling the movement device and causing the position of the bedridden patient to be adjusted.

In some embodiments, adjusting the position of a bedridden patient by a single caregiver using the movement device may move the position of the bedridden patient from a first position to a second position. In some embodiments, the position of the patient may be adjusted from a patient's side, other side, back or front to the patient's side, other side, back or front. In some embodiments, the position of the bedridden patient may be adjusted to be higher or lower on the bed. In some embodiments, the position of the bedridden patient may be adjusted to be closer to either side of the bed. In some embodiments, the position of the bedridden patient may be adjusted to a second position on the same general plane as the first position. In some embodiments, the position of the bedridden patient may be adjusted from a substantially sitting or at least partially laying down position to an at least partially laying down or substantially sitting position.

Adjusting the position of the bedridden patient may have numerous benefits or purposes. Patient who are bedridden for extended periods of time may develop pressure ulcers, which are commonly known as bedsores, if their positions are not adjusted. Furthermore, the position of a bedridden patient may need to be adjusted for a caregiver to care for the patient's daily needs. In some embodiments, the position of the bedridden patient is adjusted to prevent pressure ulcers. In some embodiments, the position of the bedridden patient is adjusted to enable washing of the patient. In some embodiments, the position of the bedridden patient is adjusted to enable changing the clothing of the patient. In some embodiments, the position of the bedridden patient is adjusted to enable exercising the patient. In some embodiments, the position of the bedridden patient is adjusted to enable rolling the patient. In some embodiments, the position of the bedridden patient is adjusted to enable making the patient more comfortable.

In some embodiments, the single caregiver pulls the movement device using at least one handle positioned on the movement device. In some embodiments, the bed surface is flat. In some embodiments, the bed surface is angled (e.g. a hospital bed wherein a portion of the bed is angled so that a patient may be reclined upright). In some embodiments, the bed surface is not substantially disturbed after the position of the bedridden patient is adjusted. In some embodiments, the method is repeated at least 1, 2, 3, 4 times, or any range of values therebetween.

The bedridden patient may suffer from one or more conditions that cause the patient to be bedridden. In some embodiments, the bedridden patient is physically incapacitated and cannot significantly assist the caregiver in maneuvering himself or herself on a bed. In some embodiments, the bedridden patient suffers from multiple trauma, suffers from a fracture of the spine, suffers from paralysis, suffers from a severe disease, suffers from a head injury, is comatose, is recovering from surgery, is obese, or any combinations thereof.

In some embodiments, the bedridden patient is about or at least about 160 lbs., 180 lbs., 200 lbs., 220 lbs., 240 lbs., 260 lbs., 280 lbs., 300 lbs., 350 lbs. or 400 lbs., or any range of values therebetween. In some embodiments, the caregiver is about or at most about 180 lbs., 170 lbs., 160 lbs., 150 lbs., 140 lbs., 130 lbs., 120 lbs., 110 lbs. or 100 lbs., or any range of values therebetween. In some embodiments, the weight ratio between the bedridden patient and caregiver is about or at least about 4:1, 3.5:1, 3:1, 2.5:1, 2.3:1, 2.2:1, 2.1:1, 2:1, 1.9:1, 1.8:1, 1.7:1, 1.6:1, 1.5:1 or 1.4:1, or any range of values therebetween.

An additional benefit of the movement device is that it may be comfortably left underneath the bedridden patient for extended periods of time. As such, the movement device may be left beneath the bedridden patient before and/or after the patient's position is adjusted. In some embodiments, the movement device is left between the bedridden patient and the bed surface for about or at least 24 hours, 18 hours, 12 hours, 10 hours, 8 hours, 6 hours, 5 hours, 4 hours, 3 hours, 2 hours or 1 hour, or any range of values therebetween.

EXAMPLES

Example 1

Example 1 describes an example movement device in accordance with the present disclosure. The movement device comprises a first layer consisting essentially of a satin material, a second layer consisting essentially of a polyester material, and a third layer consisting essentially of a cotton material. The layers of the device are sewn together. The movement device is rectangular in shape, and is about 51 inches long and 32 inches wide. The movement device further comprises 6 handles made out of a nylon webbing material and sewn onto the first layer, wherein the handles are located proximate to three of the edges of the movement device and are spaced about 15 inches from each other.

Example 2

Example 1 describes an example method of using movement device by a single caregiver in accordance with the present disclosure. A movement device, as described in Example 1, was positioned between an obese bedridden patient weighing about 295 lbs. and a bed, wherein the bedridden patient was physically incapacitated and paralyzed from below the neck, and therefore could not significantly assist a caregiver in maneuvering himself or herself on the bed. The single caregiver assisting the bedridden patient weighs about 140 lbs. Without the use of the movement device or when attempting to utilize traditional transfer sheets, the caregiver was not able to lift or pull the bedridden patient without the assistance of others, and therefore was not able to care for the needs of the bedridden patient.

However, with the use of the movement device of the present disclosure the caregiver was able to adjust the position of the bedridden patient, without further assistance from others, by pull on the handles and layers of the movement device. Once the position of the bedridden patient was adjusted, the movement device was left underneath the bedridden patient until the movement device was washed with other bed linens. In this way, the caregiver was able to adjust the position of the patient on the bed and care for the needs of the patient without significant assistance from others for about 54 months. Advantageously, and to the surprise of the bedridden patient's primary care physician, the bedridden patient's skin was in excellent condition and did not develop pressure ulcers whereas the patient had a number of pressure ulcers under different care and technology.

It will be apparent to those skilled in the art that various modifications and variations can be made in the present invention without departing from the scope or spirit of the invention. Thus, it is intended that the present invention cover the modifications and variations of this invention provided that they come within the scope of the appended claims or their equivalents.

What is claimed is:

1. A movement device to enable a single caregiver to move a patient, comprising:

a first layer comprising a low friction textile cloth;

a second layer comprising a durable textile cloth; and a third layer comprising a delicate textile cloth;

wherein the first layer is the bottom most layer of the movement device, and the third layer is the top most layer of the movement device;

wherein the first, second and third layers are secured together so as to be fixed relative to each other; and wherein the durable textile cloth is a polyester cloth.

2. The device of claim 1, wherein the low friction textile cloth is a satin material or a silk material.

3. The device of claim 1, wherein the low friction textile cloth has a dynamic frictional coefficient of at most about 0.7.

4. The device of claim 1, wherein the second layer comprises at least about 50% polyester.

5. The device of claim 1, wherein the delicate textile cloth is a cotton material.

6. The device of claim 1, wherein the delicate textile cloth is breathable.

7. The device of claim 1, wherein the movement device further comprises at least one handle positioned on the first layer.

8. The device of claim 1, wherein the movement device comprises four device edges.

9. The device of claim 8, wherein the movement device comprises 3 handles positioned on each of the four device edges.

10. The device of claim 1, wherein the movement device is machine washable.

11. The device of claim 1, wherein the first layer further comprises a water resistant material or a water proof material.

12. A movement device to enable a single caregiver to move a patient, consisting of:

a first layer formed of a satin cloth or a silk cloth;

a second layer formed of a polyester cloth; and a third layer formed of a cotton cloth;

the first layer positioned as the bottom most layer of the movement device, the third layer positioned as the top most layer of the movement device;

wherein the first, second and third layers are secured together so as to be fixed relative to each other;

the movement device having four device edges; and the movement device having 3 handles positioned on each of the four device edges.

13. The device of claim 12, wherein the first layer is formed of a satin cloth.

14. The device of claim 12, wherein the first layer if formed of a silk cloth.

15. The device of claim 12, wherein the second layer comprises at least about 50% polyester.

16. The device of claim 12, wherein the third layer is breathable.

17. The device of claim 12, wherein the movement device is machine washable.

* * * * *